United States Patent [19]

Ford

[11] Patent Number: 4,459,789

[45] Date of Patent: Jul. 17, 1984

[54] WINDOW

[76] Inventor: Donald F. Ford, 2639 Wendell, Richmond, Calif. 94804

[21] Appl. No.: 380,023

[22] Filed: May 20, 1982

[51] Int. Cl.[3] ..... E06B 7/12

[52] U.S. Cl. ..... 52/656; 52/788; 52/171; 52/398

[58] Field of Search ..... 52/171, 788, 398, 399, 52/400, 790, 172, 656, 657, 715

[56] References Cited

U.S. PATENT DOCUMENTS

| | | | |
|---|---|---|---|
| 3,192,575 | 7/1965 | Rosenau | 52/171 |
| 3,264,165 | 8/1966 | Stickel | 52/791 X |
| 3,710,074 | 1/1973 | Stewart | 52/171 X |
| 4,149,348 | 4/1979 | Pyzewski | 52/788 X |
| 4,256,808 | 3/1981 | Roy | 52/171 X |
| 4,380,994 | 4/1983 | Seeman | 52/171 X |

FOREIGN PATENT DOCUMENTS

| | | | |
|---|---|---|---|
| 1509552 | 2/1969 | Fed. Rep. of Germany | 52/788 |
| 7703613 | 10/1977 | Netherlands | 52/171 |
| 1160386 | 8/1969 | United Kingdom | 52/171 |
| 197810 | 10/1978 | United Kingdom | 52/171 |
| 595472 | 3/1978 | U.S.S.R. | 52/171 |

*Primary Examiner*—John E. Murtagh
*Assistant Examiner*—Kathryn Ford
*Attorney, Agent, or Firm*—Chernoff, Vilhauer, McClung, Birdwell & Stenzel

[57] ABSTRACT

A multi-pane thermally insulative window has a frame assembly having side rails each including a central section, side sections pivotably connected to the central section, and splines which hold the side members in a position relative to the central members in which portions of the side members and central members exert pressure toward one another against opposite sides of the margins of each pane of the window. Gas-containing spaces defined between parallel panes communicate sealingly with the interior of expandable gas reservoirs to contain gas having a low thermal coefficient of conductivity as insulating layers between parallel panes. Infrared radiation reflective material is provided as a film contained between sheets of glass or as a coating on a pane of the window to provide additional thermal insulation with relatively low decrease of visible light transmission through the window.

2 Claims, 14 Drawing Figures

WINDOW

BACKGROUND OF THE INVENTION

The present invention relates to construction of an improved window assembly for buildings, and particularly to a thermally insulating window utilizing multiple panes mounted in an improved frame.

Previously known windows constructed with multiple parallel spaced-apart layers of glass provide improved thermal insulation compared to single thicknesses of glass. In order to accommodate the changes in air pressure within the spaces between layers of glass in such windows, it has been the common practice to provide an opening communicating between the interior of the space between parallel panes of glass and the air space surrounding the window. The space between the parallel panes of glass, then, is occupied by air.

While it has been possible to make windows having sealed construction, the expense of such construction has prevented it from becoming common practice. Particularly for windows for use in houses, where the number of different sizes of windows is nearly unlimited, it is prohibitively expensive to manufacture multiple-pane windows in every desirable size. Another problem with a thermally insulating window having multiple spaced-apart parallel panes held in a thermally insulating frame so as to provide a sealed container for thermally insulating gas between the pane is that changes in barometric pressure, or in the temperature of the gas between panes can result in unacceptable pressure differentials to be carried by the panes. Furthermore the prior art does not provide such a window including a layer of a heat-reflective material as part of such a multi-pane window.

What is desired is to increase the ability of a window to provide thermal insulation and thereby prevent loss of heat from within a building, without undesirably reducing the amount of visibility through the window, or preventing the reception of solar heat within a building by transmission of visible light through the window. It is also desired to improve heat retention within a building by preventing movement of air through the window openings, by providing a tightly sealed window installation. Preferably a window meeting the above criteria should be able to be produced at a reasonably low cost in any size desired, so that it may be installed in pre-existing buildings, and to prevent available choice of window sizes from governing design of buildings where such windows are to be used. Finally, such a thermally insulating window must provide sufficient strength and a pleasantly attractive appearance. In keeping with these latter requirements, such a window should be able to accept panes of high strength plastic material, or decoratively contoured or colored panes of glass of other than ordinary thickness.

The present invention meets the requirements stated above for a thermally insulating window by providing an improved multiple-pane window. The window frame, according to the present invention, may be constructed in any desirable size by cutting frame rail members to length and assembling them with special corner block members to provide a completed window in which the multiple panes of glass or other light transmitting materials are sealingly mounted to define sealed gas-containing spaces between the panes. To accommodate changes in air pressure within the spaces between panes, an expandable gas reservoir is in communication with the interior of the space between parallel panes of glass, so that increases in the volume of the gas, brought about by changes in temperature of the air surrounding the window, may be accommodated. Nonatmospheric gas having a thermal coefficient of conductivity lower than that of air may be used alternatively to fill the spaces between parallel panes of glass, increasing the thermal insulation provided by the window of the invention.

Additionally, coatings of material which reflect energy of certain wave lengths, for example infrared radiation, while efficiently transmitting other wave lengths, including visible light, may be added to one of the panes of the window to retain heat within the building in which the window is installed.

In a preferred embodiment, the present invention comprises a generally rectangular frame, each side of which includes an elongate central section, with the ends of the central sections abutting against special corner blocks at the corners of the window. A longitudinal groove extends along the central sections and corner blocks to receive a central pane of glass, which may have a coating of a material including a copper-tin oxide or lithium-tin oxide to reflect infrared radiation. Alternatively, the central pane may be of a sandwich construction of two thin sheets of glass with a layer of material carrying a coating which is reflective of infrared radiation between the sheets of glass. On each side of the window a side section extends along the central section, being pivotally connected to the central section, for example, by interlocking lips, or hooked edges, of ribs extending along the central section and side sections generally perpendicular to the major plane of the window. The central section and each side section cooperatively define cavities for receiving, respectively, exterior and interior panes of glass. The pivotable relationship between the side sections and the central section, provided by the interlocking lips, permits the use of a spline inserted between the exterior edge of each side section and the opposite portion of the central section, in order to exert a clamping force upon the margin of each of the interior and exterior panes.

In order to prevent heat transfer by conduction through the material of the frame itself, the frame may preferably be of extruded plastic construction, for example, acrylonitrile butadiene styrene (ABS) plastic.

Resilient seal material is provided in each of the pane cavities to define essentially gas-tight spaces between the exterior and central pane and between the central pane and the interior pane. Each of these gas-containing spaces communicates with a gas reservoir such as an expandable bellows. Purge and fill valves are provided for each gas-containing space. This permits the spaces between panes to be filled with insulating gas, with changes in atomspheric pressure being accommodated by the expandable bellows prevent excessive pressure differential between the gas-containing spaces and the ambient atmosphere.

In alternative embodiments of the invention, a plastic sheet may be used in place of the exterior glass pane to provide additional strength, at a modest sacrifice of insulating value, or a single gas-containing space may include a tightly stretched sheet of polyester "heat mirror" material or the like, still providing a higher degree of insulation than is provided by conventional windows, but at a cost less than that of the triple-glazed window.

In yet another alternative construction of the window according to the present invention, a window is provided with four panes of glazing material and a layer of infrared reflective material, the panes of glazing material being held in a frame comprising two central frame members, each having a pair of side sections pivotably attached and locked in place by splines to generate gas-sealing pressure against the individual panes. The visible light-transmitting, heat reflective material is held between the adjacent side sections attached, respectively, to the two central sections.

It is, therefore, a primary objective of the present invention to provide improved thermally insulating windows having multiple panes.

It is another important objective of the present invention to provide a multiple pane window with improved frame construction including a combination of frame members providing a gas-tight seal along the margins of each pane.

It is an important feature of the present invention that it includes sealed spaces containing insulating gas between parallel panes, with gas reservoirs communicating with the gas-containing spaces between panes to compensate for changes in the volume of the insulating gas and ambient air pressure.

It is another important feature of the present invention that it provides a multiple pane window including a heat reflective film within an insulating gas-filled space.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
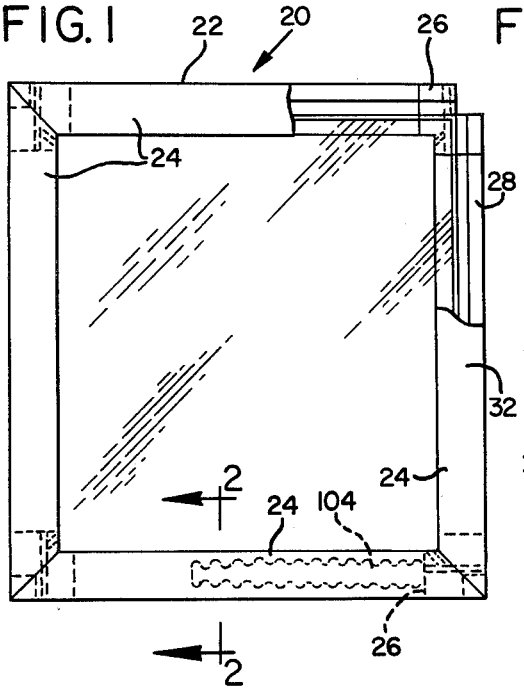
FIG. 1 is a front elevational view of a window assembly embodying the present invention, shown partially cut away.
Figure 2:
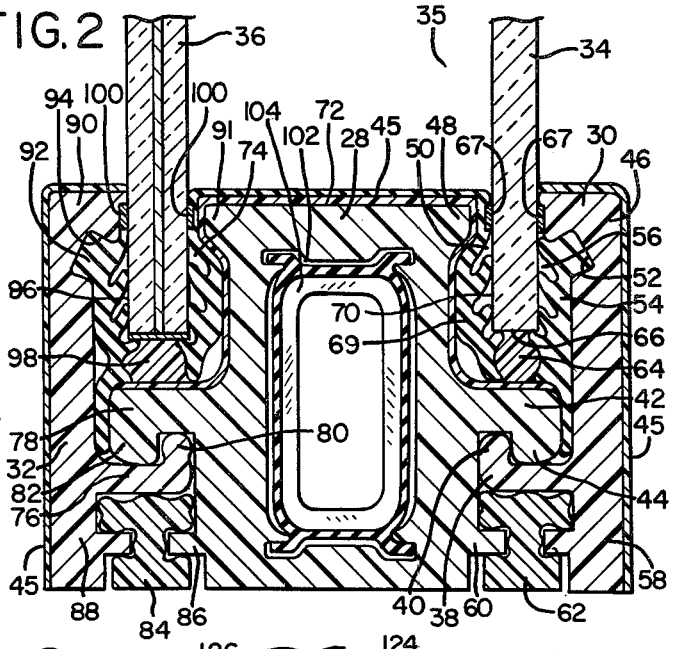
FIG. 2 is a fragmentary sectional view of the window assembly shown in FIG. 1, showing one of the frame rails and a portion of the glazing, taken along line 2—2 of FIG. 1.

Referring now to the drawings, a window assembly 20 which embodies the present invention is shown partially cut away in FIG. 1, where it may be seen that a frame 22, generally rectangular in shape, includes side rails 24 and corner blocks 26 surrounding a glazed opening. The side rails 24 each include a central section 28 and, as may be more clearly seen in FIG. 2, a pair of side sections 30 and 32. Each of the central sections 28 abuts against and is located between two of the corner blocks 26, while the side sections 30 and 32 overlap the corner blocks 26. The ends of the side sections 30 and 32 abut against one another in a mitered corner, as may be seen in FIG. 1.

The window assembly 20 includes an exterior pane of glass 34, and an interior pane 36 which includes parallel sheets of glass **36*a* and 36*b*** located on opposite sides of a thin sheet of material such as a commercially available polyester plastic film material, having a thin coating which transmits light in the visible wavelengths efficiently, but reflects radiant energy in the infrared range, available under the trademark "Heat Mirror," from the South Wall Corporation, of Palo Alto, Calif.

The side section 30 extends along the exterior side of the central section 28, having a rib 38 extending toward the central section 28 and a lip 40 extending from the rib 38 generally upwardly toward the exterior pane 34. A rib 42 extends outwardly from the central section 28 and includes a downwardly extending lip 44, which is matingly engaged with the lip 40, forming a pivotable connection between the side section 30 and the central section 28. A coating 45 of a polyvinylchloride plastic material is provided as a protective surface for the central section 28 and the side sections 30 and 32. An upper portion 46 of the side section 30 extends above the rib 38 and, cooperatively with an upper outer portion 48 of the central section 28, defines a pane cavity 50 in which the exterior pane 34 is received. A lower portion 58 of the side section 30 extends downward below the rib 38 and a lower portion 60 of the central section 28 extends downward below the rib 42. Between the lower portion 58 and the lower portion 60 is a spline 62 which holds the lower portions 58 and 60 apart from one another, causing the side section 30 to pivot about the lips 40 and 44, forcing the upper portion 46 toward the upper portion 48, and thereby applying compressive force against the margin surface 56 of the exterior pane 34. The spline 62 may be of fiberglass-reinforced plastic.

A groove 52 defined in the upper portion 46 helps to hold a seal element 54, which may for example be of neoprene between the rib 42 and the upper portion 46. The seal element 54 extends along the interior of the upper portion 46 and rests against a margin surface 56 of the exterior pane 34. The seal element 54 may be joined adhesively at the frame corners to the corresponding seal element 54 of each of the adjacent rails 24 of the frame 22 to create a gas-tight seal around the margin of the pane 34.

A moldable sealing material 64, such as a polysulfide elastomer, is located along the edge surface 66 of the exterior pane 34, and strips 67 of a friction reducing material such as a poly-tetrafluoroethylene polymer resin (for example the TFE material manufactured by the DuPont Corporation and known by the trademark TEFLON) are attached to the surfaces of the exterior pane 34 to accommodate motion of the exterior pane 34 within the cavity 50 in response to unequal rates of thermal expansion and contraction of the window assembly parts.

A preformed seal member 69 of an elastomeric material such as neoprene is located between the upper portion 48 of the central section 28 and the margin surface 70 of the pane 34, and also extends across the top 72 of the central section 28 and downward within a pane cavity 74 on the interior side of the central section 28 of each rail 24. Like the seal members 54, the seal members 69 are adhesively joined at the corners of the frame 22 to corresponding portion of each adjacent rail 24.

On the interior side of the window assembly 20, the side section 32 and central section 28, respectively, include ribs 76 and 78, having lips 80 and 82, which interact in the same manner as do the ribs 38 and 42 and lips 40 and 44. A spline 84, which may also be of fiberglass-reinforced plastic, urges the respective lower portions 86 and 88 of the interior side of the central section 28 and the side section 32 apart, and by lever action urges the upper portion 90 of the side section 32 toward the upper portion 91 of the central section 28. Thus the side section 32 presses against the margin surface 96 of the interior pane 36 within the pane cavity 74.

As with the seal member 54 on the exterior side of the window assembly, a seal member 92 is held in a groove 94 in the side section 32 and is urged into contact with the marginal surface 96 of the interior pane 36. The seal members 92 of adjacent side rails 24 of the frame 22 are adhesively joined at the corners of the frame 22 and moldable sealing material 98 and friction reducing material 100 are provided to create a gas-tight seal between the pane 36 and the rails 24.

The central section 28 defines a cavity 102, as a part of its extruded shape, providing a location within the frame rail 24 for receiving a bellows 104 which acts as a gas reservoir. The bellows 104 is expandable and sufficiently flexible to accommodate changes in volume of gas between the panes 34 and 36 while maintaining the pressure of the gas within the space 35 within a predetermined maximum difference from the ambient air pressure to prevent failure of the glass because of overpressure.

Figure 3:
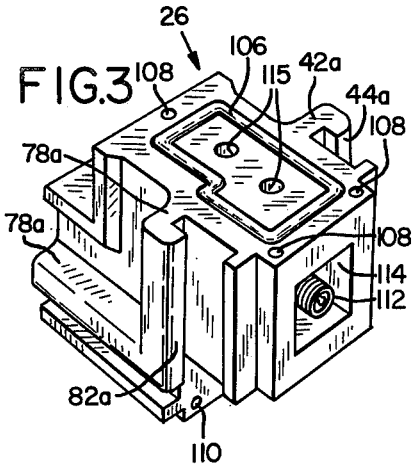
FIG. 3 is a pictorial view of a corner block which is a part of the window assembly shown in FIG. 1.

Referring now also to FIG. 3, a corner block 26 includes side portions which correspond to the general shape of the central section 28 to mate with adjacent central sections whose ends are cut off square. A seal 106 permits the corner blocks 26 to mate sealingly with the ends of the central section 28, completing a gas-tight enclosure between the exterior and interior panes 34 and 36 when the window assembly 20 is complete. Holes 108 and 110 extend through the corner block 26 to permit use of bolts to attach the corner blocks 26 to the respective central sections 28. Ribs **42*a* and 78*a* having lips 44*a* and 82*a* correspond to those of the central sections 28**.

To accomplish assembly of the central section 28, corner blocks 26, and side sections 30 and 32, the exterior corner edges of the corner blocks 26 are cut away to permit insertion of the splines 62 and 84 after mating the corner block 26 with the appropriate central sections 28 and placing the side sections 30 and 30 in the proper locations.

A purge or fill valve 112 is mounted within a cavity 114 in the corner block 26, and conduits 116 communicate between the cavity 114 within the corner block and the space 35 between the exterior pane 34 and the interior pane 36. By including a valve 112 in each of two corner blocks 26, with a conduit 115 providing communication between each valve 112 and the space 35, a non-atmospheric gas may be introduced into the space 35 to provide improved thermal insulation characteristics. For example, with a bellows 104 and space 35 filled with a gas such as bromotrifluoromethane ($CBrF_3$) also known by the trademark Freon 13B1), instead of air, the thermal conductivity through the space 35 is reduced by a factor of approximately 2.8. The seal construction of the window assembly 20, in combination with the purge and fill valve 112 and the expandable bellows 104, permits the space 35 to be charged with such a gas having a low thermal conductivity, expansion and contraction of the gas being accommodated by the expandable bellows 104.

Figure 4:
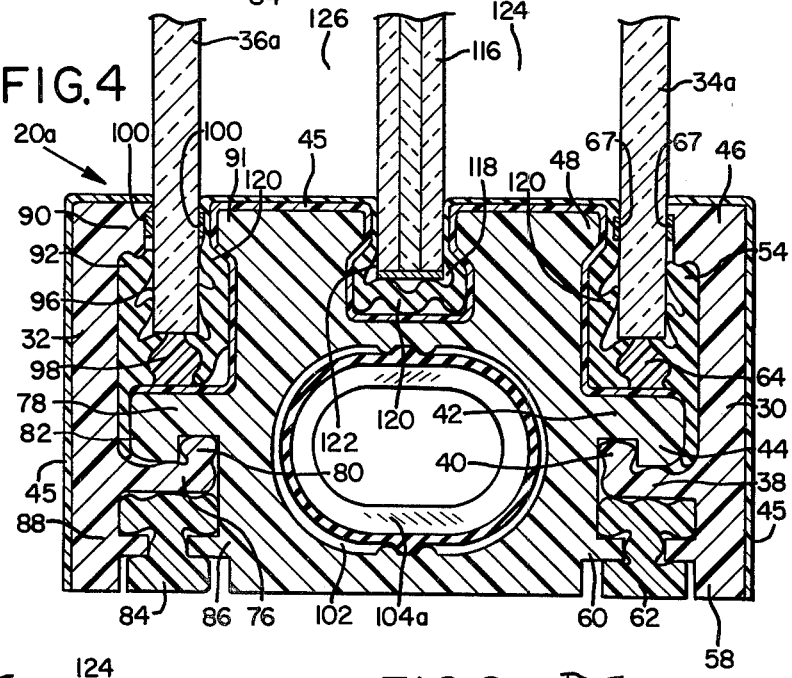
FIG. 4 is a fragmentary sectional view, similar to FIG. 2, of a window assembly which is an alternative embodiment of the present invention.

Referring now to FIG. 4, a window assembly **20*a* having a rail 24*a* may include exterior and interior panes 34*a* and 36*a* retained in pane cavities 50*a* and 74*a* similar to those of the frame rail 24, while a central pane 116 is retained in a pane cavity 118 defined in the top of the central section 28*a*. A seal element 120 corresponds to the seal element 69 of the frame rails 24, but includes a portion which extends around and exerts pressure against the marginal surfaces 122 of the central pane 116. The central pane 116 may be constructed similarly to the interior pane 36 shown in FIG. 2, thus including a pair of sheets of glass including between them a sheet of thermal radiation reflecting material. A frame assembly including the rail 24*a* also includes corner blocks (not shown) similar to the corner blocks 26, but configured to mate with the central sections 28*a* and receive the seal member 120 and central pane 116. However, as the central pane 116 provides two separate gas-containing spaces 124 and 126 between the exterior pane 34*a* and the interior pane 36*a*, two separate bellows 104 and two separate pairs of purge and fill valves 112 are provided in a window assembly 20*a* to permit separately charging each of the gas-containing spaces 124 and 126 to provide separate, independent, insulating layers of gas. The separation between the insulating layers of gas permits an exterior pane 34*a* to be of a rigid transparent plastic or other material which is stronger than glass, such as a polycarbonate plastic, but which need not be tolerant of the chemical composition of the preferred insulating gas. Nevertheless the space 126 between the central pane 116 and the interior pane 36*a* can be filled with such an insulating gas because of the separation between the gas spaces 124 and 126** and their associated gas reservoirs.

Figure 5:
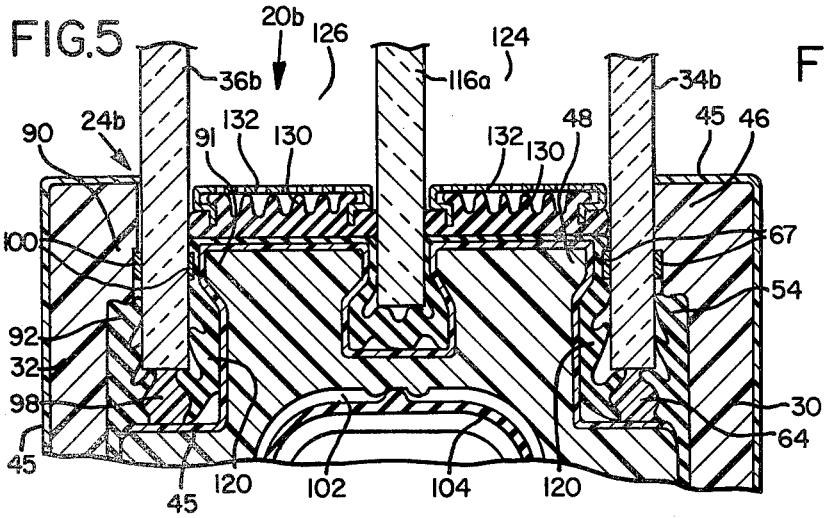
FIG. 5 is a fragmentary sectional view, similar to FIG. 2, of another alternative embodiment of the present invention.

FIG. 5 depicts a portion of a window assembly **20*b*, another alternative embodiment of the invention, having a frame rail 24*b* similar to that shown in FIG. 4, and additionally equipped with exterior, central, and interior panes 34*b*, 116*a* and 36*b* of glass. The frame rail 24*b* of FIG. 5 provides a measure of additional sound absorption ability by including an elastomeric extrusion or molding 130 having an irregular surface, and a further acoustical control member such as a perforated sheet member 132, covering the molding 130, which acts in cooperation with the molding 130 to absorb and control sound between the panes of the window. The perforated sheet member 132** may, for example, by an aluminum extrusion or be formed of aluminum sheet material. Additional sound absorption may be provided by use of other, heavier gases in place of air or the Freon 13B1 mentioned above.

Figure 6:
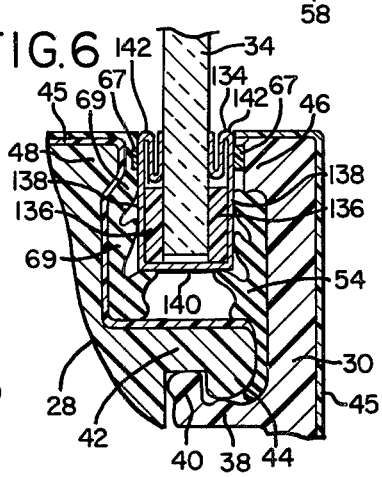
FIG. 6 is a sectional view of a detail of a window assembly according to the present invention, showing a seal for holding glass of non-standard thickness.

While the frame members 28, 30 and 32 mentioned previously are designed for economical production by extrusion of plastics such as acrylonitrile butadiene styrene (ABS) or polyvinylchloride (PVC), it is desirable to produce a minimum number of different extrusions. Therefore, to accommodate non-uniform or nonstandard thicknesses of glass or other glazing material, the present invention includes a seal assembly 134 (FIG. 6) whose exterior size equals that of the margin of a standard sheet of glass which the frame 20 is designed to accept. The seal assembly 134 includes additional strips 136 of elastomeric sealing material to sealingly fit against the surfaces of thinner nonstandard glazing materials such as thin sheets of glass or decoratively textured glass to provide a gas-tight seal and accommodate the pressure exerted, for example, by the upper portions 46 and 48 of the side section 30 and central section 28 of the frame rails 24.

The seal assembly 134 includes interconnected side and bottom walls 138 and 140, forming a "U"-shaped channel. Each side wall 138 has an upper interior edge portion 142 which includes two opposite folds to provide inwardly directed pressure upon the surface of the sheet material of the pane.

Figure 7:
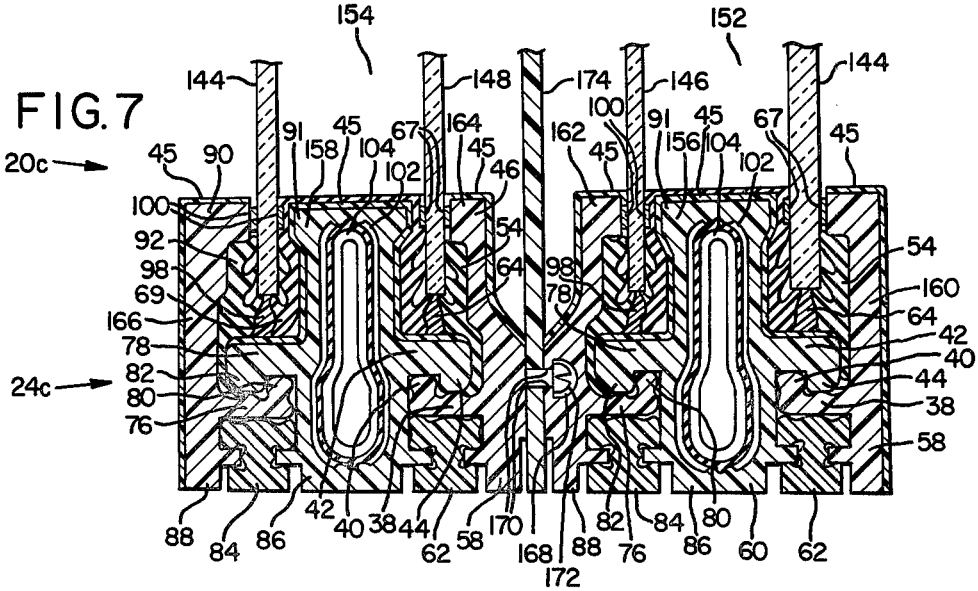
FIG. 7 is a sectional view, similar to FIG. 2, of a window assembly which is yet another alternative embodiment of the present invention.

FIG. 7 depicts, in a correspondingly oriented view, a portion of yet another alternative window assembly 20*c* embodying the present invention, in which four parallel panes 144, 146, 148 and 150 define two separate gas-enclosing sealed spaces 152 and 154 established by a rail 24*c* having two central sections 156 and 158, and respective side sections 160, 162, 164 and 166 associated therewith. The two side sections 162 and 164, which are adjacent to one another, are joined to one another by a resilient snap latch comprising a groove 168 having inwardly directed lips 170, defined in the side section 162, and a mating bifurcated tongue 172 having a catch on each bifurcation which matingly latches with a respective one of the lips 170 within the groove 168 to hold the side sections 162 and 164 together. Preferably the tongue 172 is periodically interrupted along its length, permitting a sheet of thermal radiation-reflecting material 174 such as "Heat Mirror" polyester material to be stretched over the several segments before the separate halves of the frame rail 24*c* are interconnected with one another by insertion of the tongue 172 into the groove 168.

The window assembly 20*c* of FIG. 7 may be assembled more economically than would be possible with use of a specially designed section to accept the four panes and single reflective film, since the interior and exterior pairs of panes may be assembled on the same assembly line as is used for a simpler two-pane window assembly, and the two central sections 156 and 158 may be identical to the central section 28 of the frame assembly 20.

Figure 8:
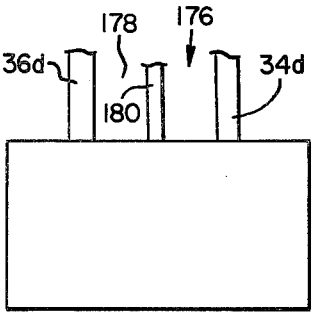
FIGS. 8–14 are schematic representations of views similar to FIG. 2 of window assemblies embodying the present invention including various combinations of glazing materials and insulating layers of gas.

Referring now to FIGS. 8–14, several window assemblies which are alternative embodiments of the present invention are disclosed schematically. In FIG. 8 a window assembly 176 includes a single sealed space 178 between an exterior pane 34*d* and an interior pane 36*d*. An infrared-reflecting film 180 is stretched within the space 178 and extends parallel with the exterior and interior panes, the space 178 being filled with air or an inert gas in order to avoid chemical action on the heat reflecting film 180.

Assuming the thermal resistance of planar air spaces as shown in Table II of Chapter 22 of ASHRAE Fundamentals 1967, for an air space 178 0.75 inch thick, oriented vertically, with horizontal heat flow, 50° Fahrenheit mean temperature, and 10° Fahrenheit temperature difference, thermal resistance of the window assembly 176 is calculated as shown below:

| | | |
|---|---|---|
| 1. Exterior glass and associated air film | R | .43 |
| 2. Air space (emissivity equals .15) | R | 2.72 |
| 3. Infrared-reflecting coated plastic film | R | .3 |
| 4. Interior glass and associated air film | R | .93 |
| Total | R | 4.38 |

Figure 9:
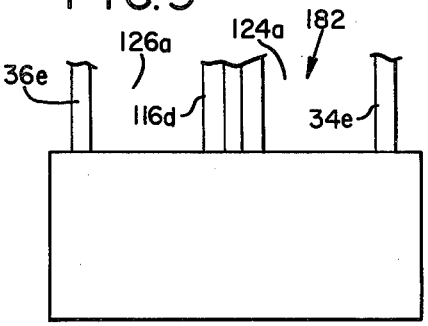

Similarly applying the same functions and calculations to a triple-glazed window assembly 182, as shown in FIG. 9, in which exterior and interior glass panes 34*e* and 36*e* and a central sandwich pane 116*d* consisting of two sheets of glass surrounding a heat reflector film form two separate gas-containing 0.75-inch-thick spaces 124*a* and 126*a* filled with bromotrifluoromethane, $CBrF_3$, the thermal resistance of the window assembly is as follows:

| | | |
|---|---|---|
| 1. Exterior glass and associated air film | R | .43 |
| 2. Gas space (emissivity equals .15) | R | 7.83 |
| 3. Central glass and infrared-reflecting film sandwich | R | .8 |
| 4. Gas space (emissivity equals .15) | R | 7.83 |
| 5. Interior glass and associated air film | R | .93 |
| Total | R | 17.82 |

In the window assembly 184, shown schematically in FIG. 10, when a transparent plastic exterior pane 34*f* is used with air in the gas-containing space 124*b*, and with bromotrifluoromethane in the gas-containing space 126*b*, thermal resistance may be computed as follows:

| | | |
|---|---|---|
| 1. Exterior plastic pane and associated air film | R | .43 |
| 2. Air film space (emissivity equals .15) | R | 2.72 |
| 3. Central glass and infrared-reflecting film sandwich | R | .8 |
| 4. Gas filled space (emissivity equals .15) | R | 7.83 |
| 5. Interior glass and associated air film | R | .93 |
| Total | R | 12.71 |

Because the cost of the "Heat Mirror" sandwich pane 116 involves two sheets of glass and the polyester film, the cost of a window including the "Heat Mirror" sandwich may not be justifiable in terms of the return in increased thermal resistance. For that reason, the window assembly 186 shown in FIG. 11 includes triple glazing of glass panes 34*g*, 188 and 36*g* defining two separate gas-filled spaces 124*c* and 126*c* each containing bromotrifluoromethane, to produce a total thermal resistance of 7.48 calculated as follows:

| | | |
|---|---|---|
| 1. Exterior glass and associated air film | R | .43 |
| 2. Gas space (emissivity equals .82) | R | 2.91 |
| 3. Central glass | R | 0.7 |
| 4. Gas space (emissivity equals .82) | R | 2.91 |
| 5. Interior glass and associated air film | R | .93 |
| Total | R | 7.48 |

Figure 10:
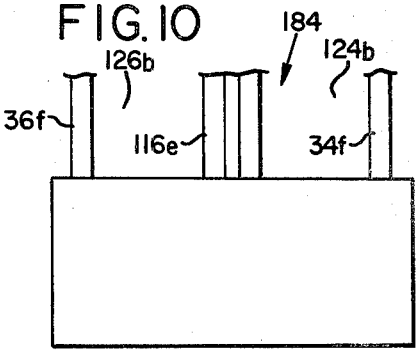
Figure 11:
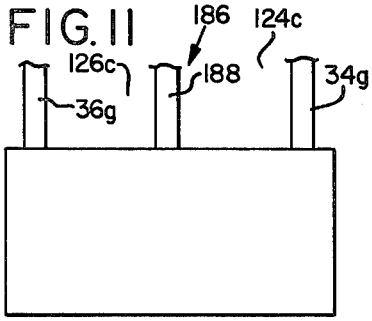
Figure 12:
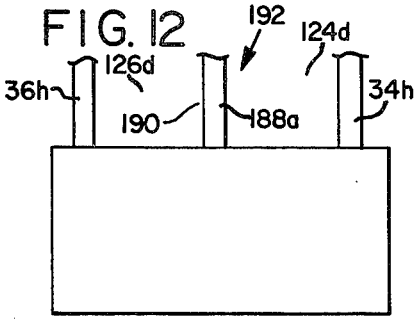

Instead of the sandwiched glass and film pane 116*d* or 116*e* of FIG. 9 or 10, a less expensive reflective coating 190 of copper-tin oxide or lithium-tin oxide is provided on the central pane 188*a* of FIG. 12. Such coated glass is available through Guardian Glass Inc., of Carleton, Mich. The thermal resistance of a window assembly 192 such as that shown in FIG. 12 may be increased to 9.9, computed as follows:

| | | |
|---|---|---|
| 1. Exterior glass and associated air film | R | .43 |
| 2. Gas space (emissivity equals .50) | R | 4.12 |
| 3. Central glass and coating | R | .3 |

-continued

| | | | |
|---|---|---|---|
| 4. Gas space (emissivity equals .50) | | R | 4.12 |
| 5. Interior glass and associated air film | | R | .93 |
| | Total | R | 9.9 |

Figure 13:
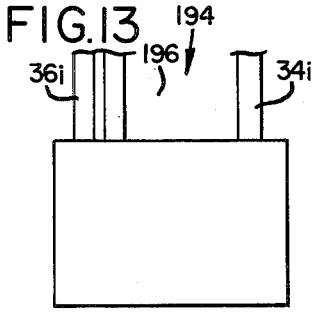

An only slightly less efficient system, such as the window assembly 194 shown in FIG. 13, includes a single gas-filled sealed space 196 containing bromotrifluoromethane contained by a single exterior glass pane 34*i* and an interior combination pane 36*g* of two sheets of glass sandwiched around a "Heat Mirror" infrared reflective coated plastic film. Its thermal resistance is calculated as follows:

| | | | |
|---|---|---|---|
| 1. Exterior glass and associated air film | | R | .63 |
| 2. Gas space (emissivity equals .15) | | R | 7.83 |
| 3. Interior glass and infrared-reflecting film sandwich and associated air film | | R | .93 |
| | Total | R | 9.39 |

Figure 14:
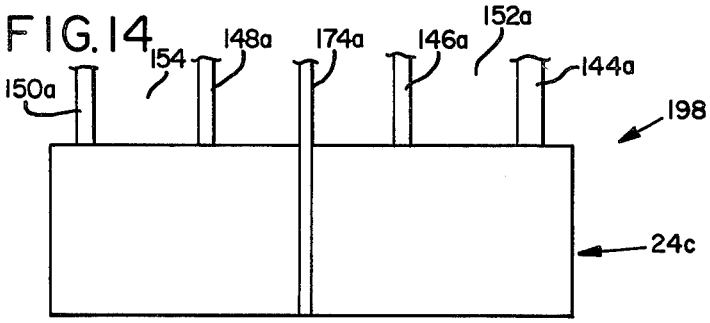

Finally, FIG. 14 shows schematically a window assembly 198, having four panes of glass 144*a*, 146*a*, 148*a* and 150*a*, gas-confining spaces 152*a* and 154*a* and infrared-reflecting coated plastic film 174*a* comparable to the window assembly 20*c* shown as a detailed structure in FIG. 7. The thermal resistance of such a structure, assuming again the same separation between panes (0.75 inch) may be calculated as follows:

| | | | |
|---|---|---|---|
| 1. Exterior glass and associated air film | | R | .43 |
| 2. Gas-filled space (emissivity equals .82) | | R | 2.91 |
| 3. Interior glass | | R | .3 |
| 4. Air space including infrared-reflecting film | | R | 2.72 |
| 5. Second interior glass | | R | .3 |
| 6. Second gas-filled space (emissivity equals .82) | | R | 2.91 |
| 7. Interior glass and associated air film | | R | 0.93 |
| | Total | R | 10.5 |

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A frame assembly for a thermally efficient multi-paned window, comprising:

(a) a plurality of frame rails each including a central section;

(b) a respective side section configured to mate with each said central section along one side thereof;

(c) respective pane cavity means, defined between said central and side sections, for receiving a peripheral margin of a window pane;

(d) connection means for attaching each said side section to the respective central section while permitting movement of said side section relative to each said central section in order to apply pressure along said peripheral margin of said window pane within said pane cavity means, said connection means including respective innerlocking lip portions associated with each said central section and said side section;

(e) locking means associated with each said central and the respective side section for urging said side section relative to said central section in a manner to apply said pressure and sealingly hold said peripheral margin in said pane cavity means; and (f) said connection means being located outwardly adjacent said pane cavity means, and said locking means including spine means for extending along the said frame means exterior of said connecting means for urging a portion of said side section away from said central section and pivoting said side section about said connection means and urging an upper portion of said side section toward a portion of said central section, providing compressive force against said peripheral margin.

2. The frame assembly of claim 1 including corner block means for abutting against each of a plurality of said central sections meeting one another at respective corners of said frame assembly, each of said corner block means including lip means for holding said side section alongside a portion thereof.

* * * * *